US007218296B2

(12) United States Patent
Wang et al.

(10) Patent No.: US 7,218,296 B2
(45) Date of Patent: May 15, 2007

(54) ACTIVE MATRIX ORGANIC ELECTROLUMINESCENCE LIGHT EMITTING DIODE DRIVING CIRCUIT

(75) Inventors: Wen-Chun Wang, Taichung (TW); Chien-Chung Kuo, Taichung County (TW); Shin-Tai Lo, Miaoli (TW); Hsi-Rong Han, Taichung County (TW); Wen-Tui Liao, Taichung (TW)

(73) Assignee: Wintek Corporation, Taichung (TW)

( * ) Notice: Subject to any disclaimer, the term of this patent is extended or adjusted under 35 U.S.C. 154(b) by 604 days.

(21) Appl. No.: 10/802,747

(22) Filed: Mar. 18, 2004

(65) Prior Publication Data

US 2005/0206591 A1 Sep. 22, 2005

(51) Int. Cl.
*G09G 3/32* (2006.01)

(52) U.S. Cl. ..... 345/82; 345/76; 345/92; 315/169.3

(58) Field of Classification Search ..... 345/74.1, 345/76, 77, 82–84, 87–90, 92, 99, 211–212, 345/214; 315/169.1, 169.3
See application file for complete search history.

(56) References Cited

U.S. PATENT DOCUMENTS 6,229,506 B1 5/2001 Dawson et al.
6,307,322 B1 * 10/2001 Dawson et al. ..... 315/169.1
2003/0128200 A1 * 7/2003 Yumoto ..... 345/211
2004/0178407 A1 * 9/2004 Lin ..... 257/40
2005/0068271 A1 * 3/2005 Lo ..... 345/76

OTHER PUBLICATIONS

Fish et al., "32.1 Invited Paper: A Comparison of Pixel Circuits for Active Matrix Polymer/Organic LED Displays" SID 02 Digest pp. 968-970.

* cited by examiner

*Primary Examiner*—Richard Hjerpe
*Assistant Examiner*—Mansour M. Said
(74) *Attorney, Agent, or Firm*—Bacon & Thomas, PLLC

(57) ABSTRACT

A driving circuit of active matrix organic electroluminescence diode is disclosed. Each pixel includes three TFTs and two capacitors. A gate of scan reset TFT is controlled by the scan line of the row where the pixel is located and a drain of scan reset TFT is connected to the data line of the column where the pixel is situated. Detect TFT is controlled by one Threshold-Lock line. One capacitor Cd is used to store data voltage (Vdata) of image signals and the other capacitor Ct is used to store the threshold voltage (Vth) of driving TFT. Therefore, the sum of capacitors Cd and Ct will drive the driving TFT to output the corresponding current to the organic electroluminescence element.

10 Claims, 6 Drawing Sheets

ACTIVE MATRIX ORGANIC ELECTROLUMINESCENCE LIGHT EMITTING DIODE DRIVING CIRCUIT

FIELD OF THE INVENTION

This invention relates to a driving circuit of active matrix organic electroluminescence light emitting diode display. More particularly, the invention is directed to a driving device that improves the non-uniform phenomena on an active matrix organic light-emitting diode display panel.

BACKGROUND OF THE INVENTION

An OLED Display can be classified according to its driving method, passive-matrix (PMOLED) and active-matrix (AMOLED). AMOLED uses TFT (Thin Film Transistor) with a capacitor for storing data signals that can control OLED levels of brightness.

The manufacturing procedure of PMOLED is simpler in comparison and is less costly of the two; however, it is limited in its size (<5 inches) because of its driving mode and a lower resolution display application. In order to produce an OLED display with higher resolution and larger size, utilizing active-matrix driving is necessary. The so-called AMOLED uses TFT (Thin Film Transistor) with a capacitor for storing data signals, so that pixels can maintain their brightness after line scanning; on the other hand, pixels of passive matrix driving only light up when the scan line selects them. Therefore, with active matrix driving, the brightness of OLED is not necessarily ultra-bright, resulting in longer lifetime, higher efficiency and higher resolution. Naturally, TFT-OLED with active matrix driving is suitable for display application of higher resolution and excellent picture due to the unique qualities of OLED.

LTPS (Low Temperature Poly-Silicon) and a-Si (amorphous Silicon) are both technologies of TFT integrating on glass substrate. The obvious differences are electric characteristics and complexity of process. Although LTPS-TFT possesses higher carrier mobility and higher mobility means more current can be supplied, the process is much more complex. However, the process of a-Si TFT is simpler and more mature, except for low carrier mobility. Therefore, a-Si process has better competitive advantages in cost.

As mobility of LTPS-TFT is up to 100~200 $cm^2$ /V-sec currently, TFT-OLED driving IC and data IC can be LTPS processed; however, due to limitations of LTPS processing capability, properties of each TFT element vary. The most pressing problem of AMOLED is how to reduce the impact of uneven LTPS-TFT characteristics. Such an issue requires an immediate solution for follow-up development and applications since images with erroneous gray scales show up on OLED panels and seriously damage image uniformity.

U.S. Pat. No. 6,229,506 discloses an Active Matrix Light Emitting Diode Pixel Structure And Concomitant Method. A 4T2C (4 TFTs and 2 capacitors) pixel circuit is proposed as shown in FIG. 1. An Auto-Zero mechanism is applied to compensate for threshold voltage differences of TFT elements to improve the uniformity of images. Driving sequences of control signals include Auto-Zero Phase 210, Load Data Phase 220 and Illuminate Phase 230. Refer to FIG. 2 for the sequences of control signals.

Transistors T3 and T4 are off and transistor T2 is on prior to Auto-Zero Phase 210. The current passing through OLED 160 at this moment is current of the previous frame and controlled by Vsg of transistor T1 (voltage difference between source and gate; i.e., voltage difference of both ends of Cs).

After entering the Auto-Zero Phase 210, transistor T4 is on and then transistor T3 is on, too so that drain and gate of transistor T1 can connect as a diode. As transistor T2 is off, gate voltage of transistor T1 will increase, which equals to Vdd minus threshold voltage (Vth) of transistor T1. That is to say, the voltage difference stored at both ends of capacitor Cs is the threshold voltage of transistor T1. After placing transistor T3 off, threshold voltage (Vth) of transistor T1 can be stored into capacitor Cs and Auto-Zero Phase 210 is completed.

On Load Data Phase 220, when the voltage difference of data line 110 is ΔV, it couples to the gate of transistor T1 through transistor T4 and capacitor Cc. Thus, voltage difference stored at both ends of capacitor Cs will be $\Delta V \times [Cc/(Cc+Cs)]$ adding Vth that is stored in capacitor Cs previously. That is, Vsg of transistor T1 includes Vth of transistor T1, which makes output current of transistor T1 relate to voltage change (ΔV) of data line 110 and capacity of capacitors Cc and Cs, instead of being affected by Vth of transistor T1 in every pixel.

Lastly, when Illuminate Phase 230 begins, transistor T4 is off and transistor T2 is on. Output current of transistor T1 at the present frame will flow through OLED 160 to illuminate.

Though this 4T2C pixel circuit may compensate for the threshold voltage (Vth) differences of transistor elements in each pixel and improve integral uniformity of images; however, other control lines like Auto-Zero Line 130 and Illuminate Line 140 are required in addition to data line 110, scan Line 120 and supply line (Vdd) 150. Capacitor Cs has to record all threshold voltages and part of the data voltages loaded. Besides, a capacitance coupling approach is used to load data, which not only makes the driving method more complicated, but also increases manufacturing costs when a non-standard data driving IC is required.

To solve the same problem, Philips also published a thesis with the subject of ⌈ A Comparison of Pixel Circuits for Active Matrix Polymer/Organic LED Displays⌋. One 4T2C pixel circuit is presented in the thesis as FIG. 3 shows. It skillfully changes the location of connecting two capacitors in the pixel circuit of the U.S. Pat. No. 6,229,506 (FIG. 1) to solve the defects of complexity and impracticability. However, control lines like Auto-Zero Line 330 and Illuminate Line 340 are also required in addition to data line 310, scan line 320 and supply line (Vdd) 350, just like those in U.S. Pat. No. 6,229,506.

The sequences of driving control signals are the same as those in the U.S. Pat. No. 6,229,506 since they consist of Auto-Zero Phase, Load Data Phase and Illuminate Phase.

On Auto-Zero Phase, Transistor T34 is off and then transistor T33 is on so that drain and gate of transistor T31 can be connected as a diode. As transistor T32 is off, gate voltage of transistor T31 will increase, which equals to Vdd minus threshold voltage (Vth) of transistor T31. That is to say, the sum voltage stored at capacitors C1 and C2 is the threshold voltage (Vth) of transistor T31. After placing transistor T33 off, Auto-Zero Phase is completed.

Data voltage is conducted through connection of transistor T34. Data voltage is stored in capacitor C1 and a certain proportion of Vth previously stored at both ends of capacitor C2 is still maintained, which equals to $[C1/(C1+C2)] \times Vth$. Thus, the sum of capacitors C1 and C2 is $(Vdd - Vdata + [C1/(C1+C2)] \times Vth)$; i.e., Vsg of transistor T31 contains part of Vth of transistor T31, which may not only reduce the correlation between the output current and threshold voltage of transistor T31, but also compensate for part of the threshold voltage (Vth) difference resulting from processing factors.

The threshold voltage of transistor T31 in the thesis is memorized by two capacitors (C1 & C2). Part of the threshold voltage data stored in one of the capacitors will get lost while loading data voltage. Therefore, this approach can only make up for part of the threshold voltage difference resulting from processing.

SUMMARY OF THE INVENTION

Hence, a voltage type of AMOLED driving circuit that can compensate for TFT threshold voltage variations is presented in this invention so as to improve image defects resulting from uneven characteristics of TFT.

To achieve the objective above, a driving device of each pixel presented in this invention includes 3 TFTs and 2 capacitors, which are 1 scan reset TFT, 1 detect TFT, 1 driving TFT, 2 capacitors (Cd & Ct) and 1 organic electroluminescence element. The gate of scan reset TFT is controlled by the scan line of the row where the pixel is located. Detect TFT is controlled by one threshold-lock line. Capacitor Cd is used to store data voltage (Vdata) of image signals and capacitor Ct is used to store threshold voltage (Vth) of driving TFT. Therefore, the sum voltage stored at capacitors Cd and Ct will force driving TFT to output a corresponding current to the organic electroluminescence element.

DETAILED DESCRIPTION OF THE PREFERRED EMBODIMENTS

Figure 1:
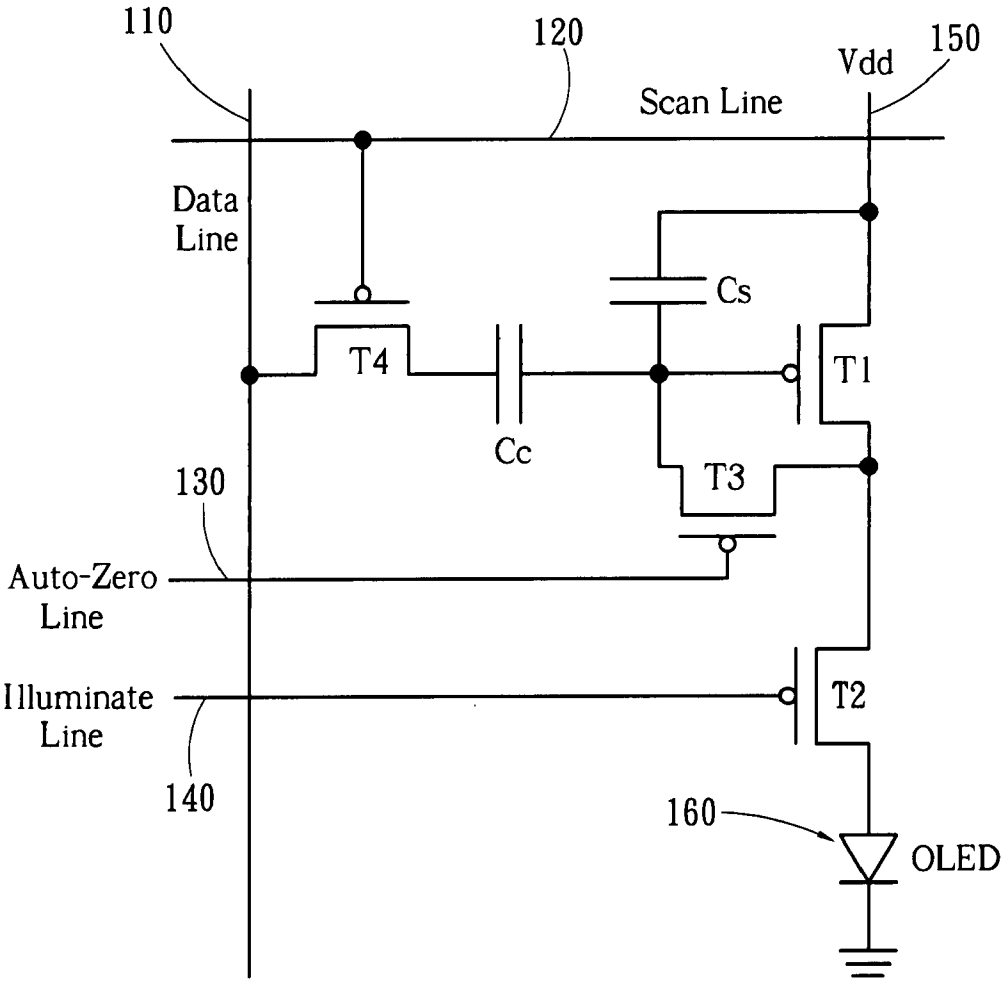
PRIOR ART Fig. 1
FIG.1 is a schematic pixel circuit diagram of U.S. Pat. No. 6,229,506.
Figure 2:
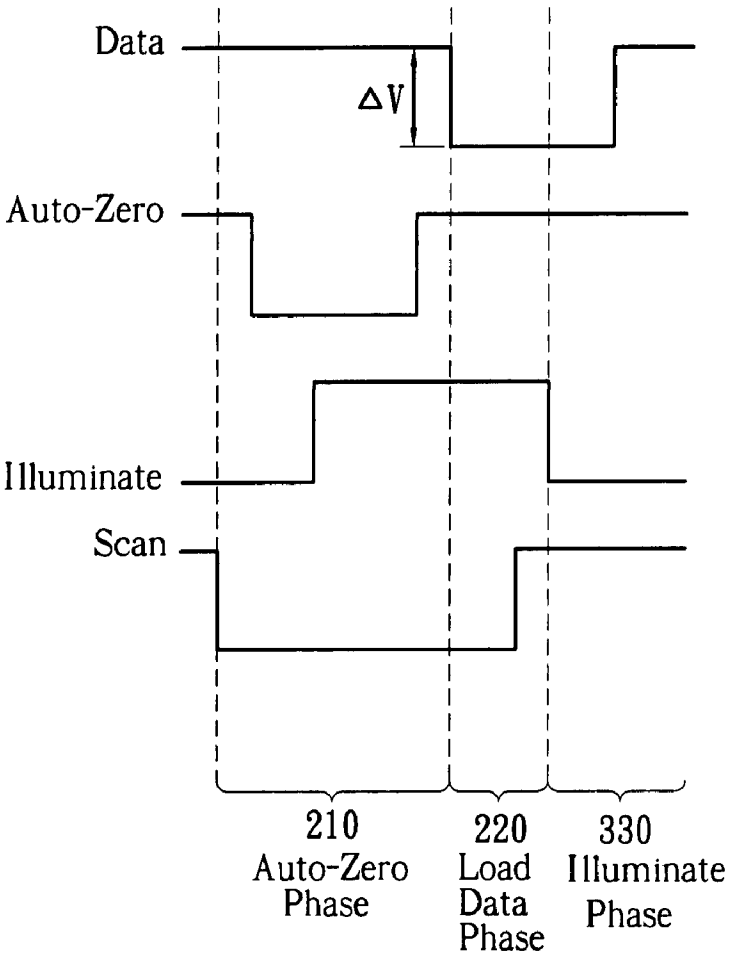
PRIOR ART Fig. 2
FIG. 2 is a schematic diagram of control signal time sequence of U.S. Pat. No. 6,229,506.
Figure 3:
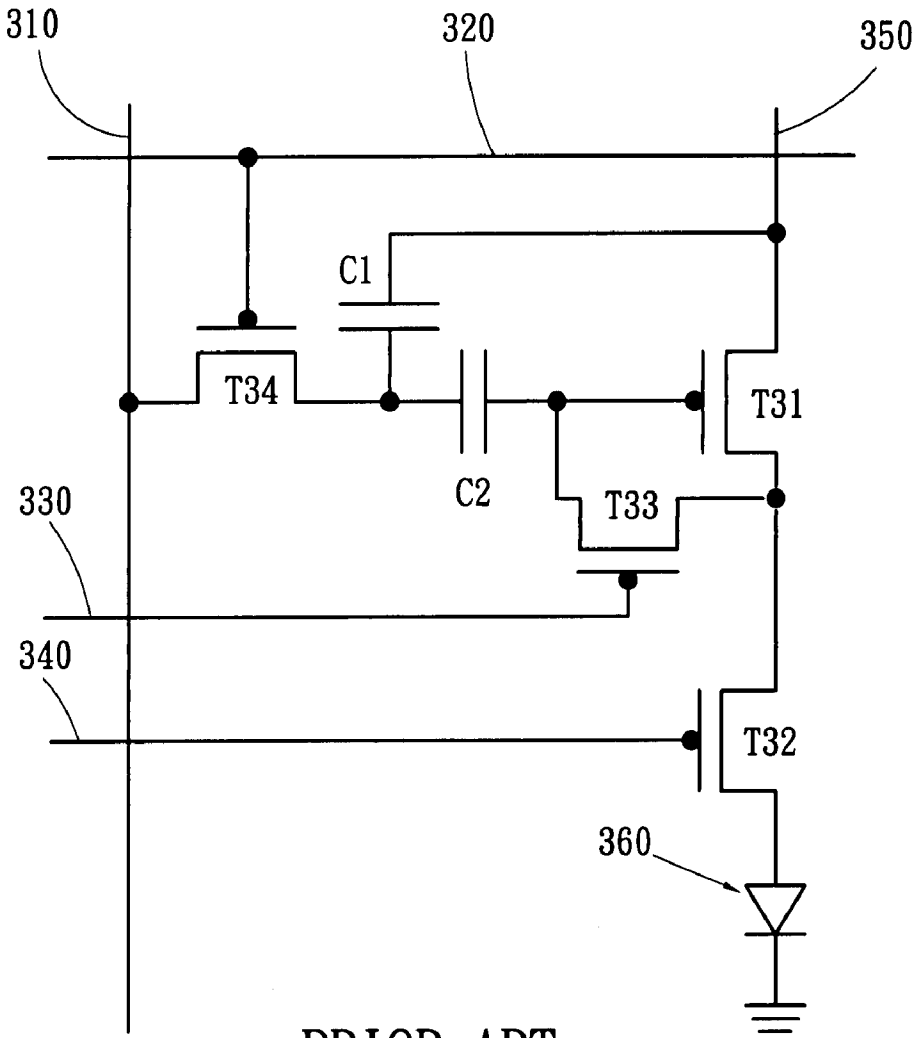
PRIOR ART Fig. 3
FIG. 3 is the pixel circuit in the thesis published by PHILIPS.
Figure 4:
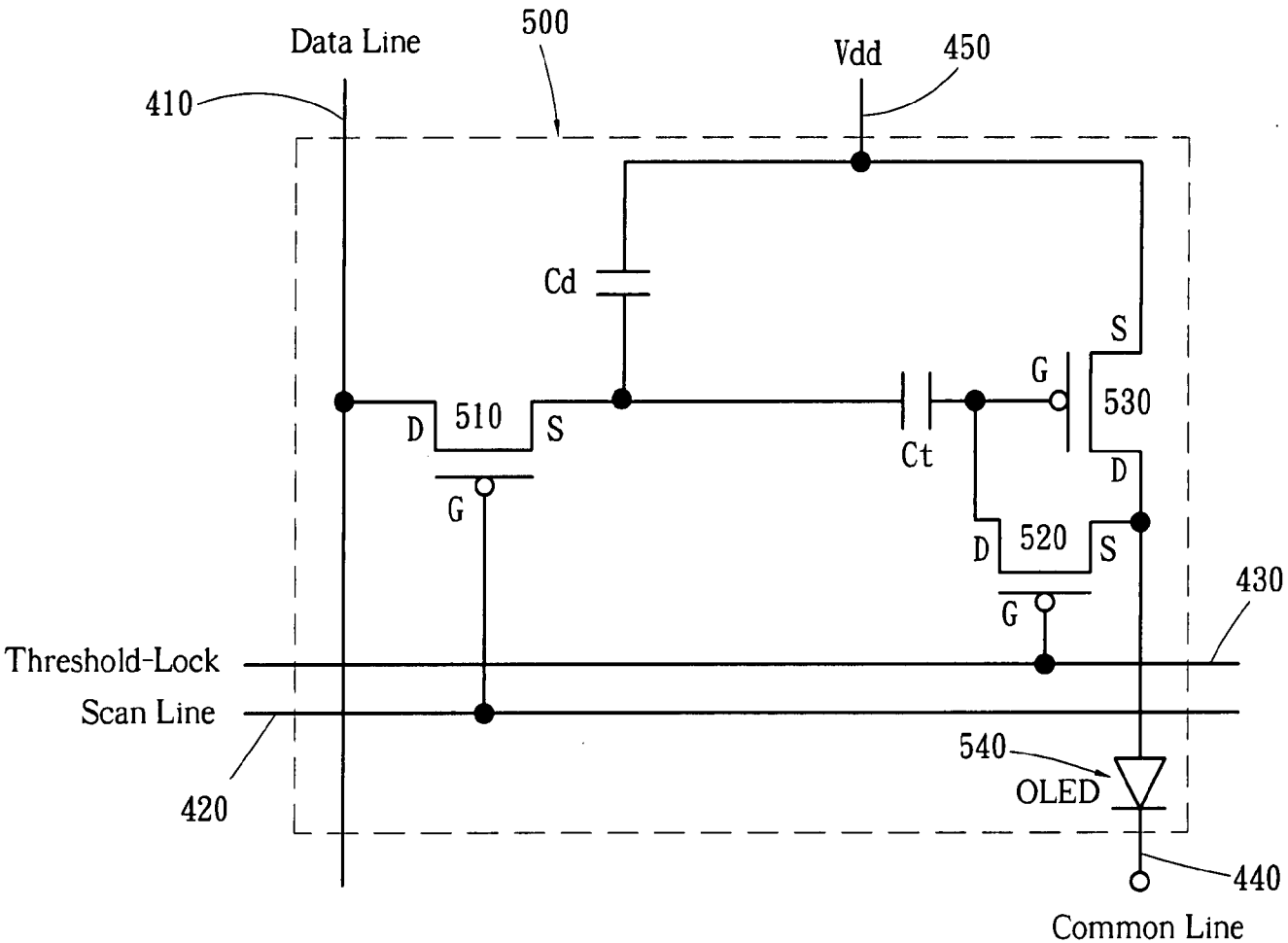
FIG. 4 is the pixel circuit for this invention.
Figure 5:
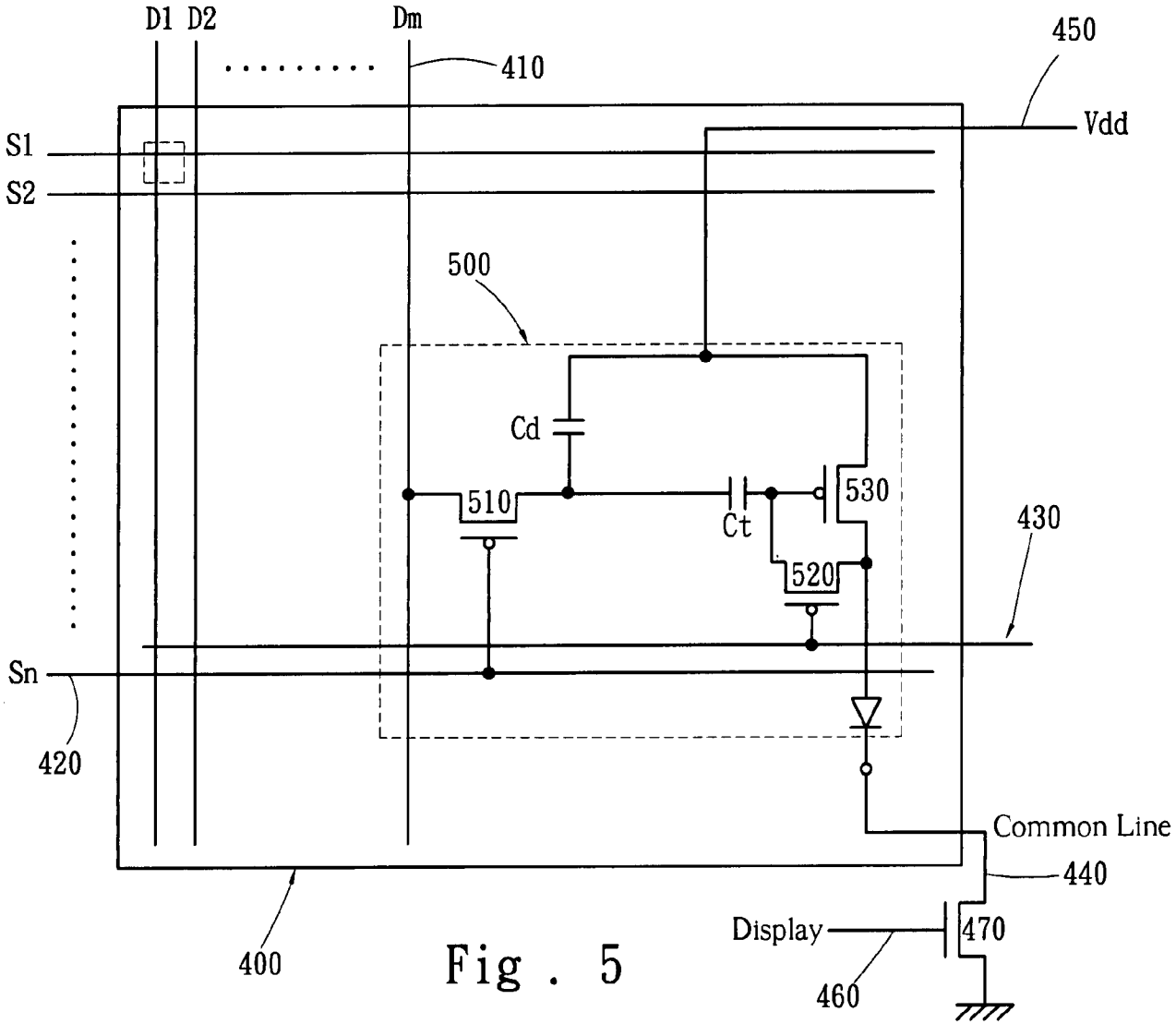
FIG. 5 is the connection and control of a pixel circuit in this invention.

Refer to FIGS. 4 & 5 for the circuit, connection and control of each pixel in this invention. As the Figures show: the driving circuit of pixel 500 on the display panel 400 composed of one scan line 420 and one data line 410 includes 3 TFTs, 2 capacitors and 1 organic electro-luminescence element connected as follows:

Gate of a scan reset TFT 510 connected to one scan line 420 and drain connected to a data line 410. Two ends of storage capacitor Cd installed between source of the scan reset TFT 510 and supply line Vdd 450.

Source of a driving TFT 530 connected to the supply line Vdd 450.

Gate of a detect TFT 520 connected to a Threshold-Lock 430, drain connected to gate and source connected to drain of driving TFT 530. Two ends of compensation capacitor Ct installed between source of the scan reset TFT 510 and drain of detect TFT 520.

Anode of an organic electroluminescence element 540 connected to the drain of driving TFT 530 and cathode connected to a common Line 440.

Refer to FIG. 5. As the Figure shows: a joint where a scan line 420 (S1, S2, S3 . . . Sn) and a data line 410 (D1, D2, D3 . . . Dm) meet is a pixel 500. Refer to FIG. 4, and FIG. 5. The gate of scan reset TFT 510 is controlled by scan line 420 of the row where Pixel 500 is located, and the drain is connected to data line 410 of the column where Pixel 500 is situated. Detect TFT 520 is controlled by Threshold-Lock 430. Capacitor Cd is used to store data voltage (Vdata) of image signals and capacitor Ct is used to store threshold voltage (Vth) of driving TFT 530. Therefore, the sum of voltage stored in capacitors Cd and Ct will force driving TFT 530 for an output of corresponding current to the organic electroluminescence element 540.

Detect TFT 520 of each Pixel 500 on display panel 400 is controlled by the same Threshold-Lock 430 and source of driving TFT 530 is jointly connected to the same supply line (Vdd) 450. Cathode of organic electroluminescence element 540 in every Pixel 500 is jointly connected to a common line 440, which is grounded via an external switch 470 controlled by a display line 460.

Figure 6:
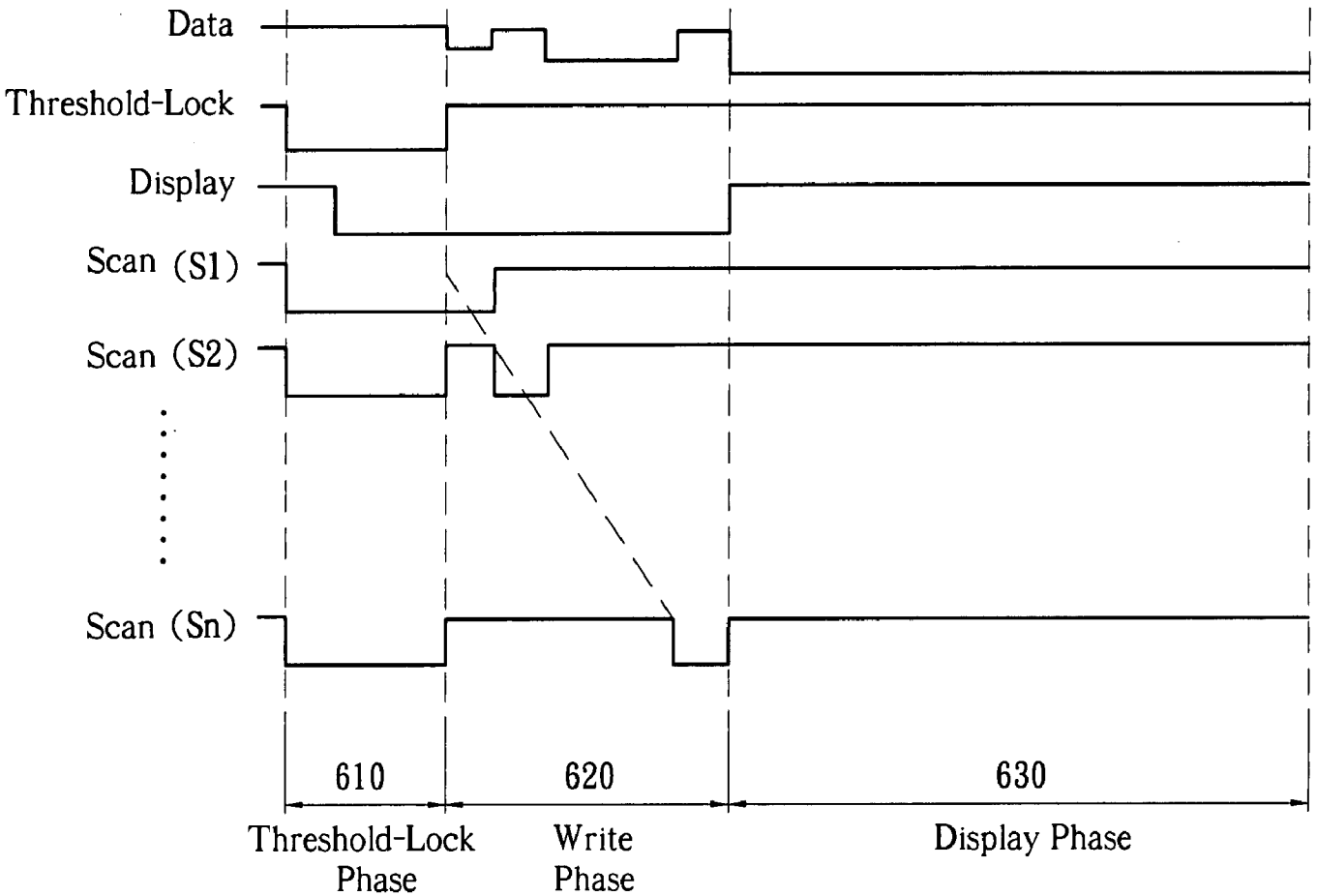
FIG. 6 is the sequences of control signals in this invention.

Actuation procedures of this invention are described as follows:

Refer to FIG. 6 for the sequences of control signals in this invention. A cycle of driving signals can be divided into three phases. First, Threshold-Lock Phase 610:

Signals of scan line 420 and Threshold-Lock 430 will trigger scan reset TFT 510 and detect TFT 520 in every pixel circuit on. The voltage level of reset data line 410 will be the same as that of supply line (Vdd) 450. When scan reset TFT 510 is on, capacitor Cd storing voltage of image data will discharge via scan reset TFT 510 and data line 410. Display signal line 460 controls Switch 470 outside of display panel 400 and makes it off. Thus, an open circuit exists between common line 440 and the grounding end of the system. The current of driving TFT 530 stops flowing through organic electroluminescence element 540, and diverts to detect TFT 520 that is currently on, which forces driving TFT 530 to detect the threshold voltage. As the current of driving TFT 530 passes by detect TFT 520, capacitor Ct and scan reset TFT 510, voltage stored in capacitor Ct becomes smaller and smaller, which makes the current of driving TFT 530 become smaller until no current is left.

At last, capacitor Cd won't store any electric charge (0 voltage on both ends) and voltage difference on both ends of capacitor Ct will equal to threshold voltage (Vth) of driving TFT 530; i.e. when capacitor Cd discharges and resets, capacitor Ct will memorize the threshold voltage (Vth) of driving TFT 530 (Refer to FIG. 4 for Pixel 500 circuit.). In summary, threshold voltage (Vth) of driving TFT 530 in every Pixel 500 circuit will be stored in its own capacitor Ct after Threshold-Lock Phase 610.

Next, signals of scan line 420 and Threshold-Lock 430 will trigger scan reset TFT 510 and detect TFT 520 in every Pixel 500 circuit off for the following write Phase 620.

In write Phase 620, each scan line 420 (S1, S2 . . . Sn) will send out scan signals in order. When scan signals shift to scan line 420, all scan reset TFT 510 on the same scan line will be on and detect TFT 520 will be off. Data voltage (Vdata) of data line 410 can be stored into capacitor Cd as scan reset TFT 510 is on; however, threshold voltage (Vth) previously memorized by capacitor Ct will still be retained as detect TFT 520 is off. Thus, voltage difference between two ends of capacitor Cd will be equivalent to supply voltage (Vdd) minus data voltage (Vdata); i.e. voltage at both ends of capacitor Cd is (Vdd−Vdata). Therefore, the sum of voltage stored in capacitors Cd and Ct will equal to (Vdd−Vdata+Vth), which enables Driving TFT 530 to output corresponding current to organic electroluminescence element 540 in the following phase (display phase 630). Consequently, the current (I) can be expressed with a formula as follows:

$$I=(1/2)\times\beta\times(Vsg-Vth)^2$$

$$I=(1/2)\times\beta\times(Vdd-V\text{data}+Vth-Vth)^2$$

$$I=(1/2)\times\beta\times(Vdd-V\text{data})^2$$

From the above equations (β is the Transconductance Parameter of driving TFT 530), the current (I) generated by driving TFT 530 is irrelevant to the threshold voltage (Vth) of its own, but only correlated to write data voltage (Vdata). Thus, threshold voltage differences of TFT resulting from processing factors can be compensated for.

When the last scan line 420 (Sn) completes writing data voltage (Vdata), display line 460 controls switch 470 to switch on and common line 440 connects to the grounding end of the system for the third stage of display phase 630.

In display phase 630, driving TFT 530 in each Pixel 500 circuit will output current (I) relating to the written data voltage (Vdata) and organic electroluminescence element 540, which produces proper luminance. Output current (I) is not related to the threshold voltage (Vth) of driving TFT 530.

In comparison with the U.S. Pat. No. 6,229,506, only one extra reset is required in this invention before loading data voltage to complete the Threshold-Lock Phase 610 and avoid complexity.

To compare the thesis published by PHILIPS with the subject of ⌈ A Comparison of Pixel Circuits for Active Matrix Polymer/Organic LED Displays⌋, the technology of this invention is to record all threshold voltages into one capacitor (capacitor Ct) to offset the effects of threshold voltage differences.

Two capacitors (Cd & Ct) are used in this invention to deal with two different things. One capacitor Ct is responsible to record all threshold voltage values (Vth) and the other capacitor Cd is in charge of recording all data voltage values (Vdata). It is different from U.S. Pat. No. 6,229,506 as the capacitor Cs has to record all threshold voltages (Vth) and part of data voltage (Vdata) loaded. It is also different from the thesis released by PHILIPS as capacitors C1 and C2 record threshold voltages jointly. Part of the threshold voltage stored in Capacitor C1 will be lost since capacitor C2 only records part of it.

To conclude, the AMOLED driving circuit of this invention has the following advantages:

1. As all threshold voltage values (Vth) can be stored in one capacitor Ct (threshold voltage storage capacitor), the effects of threshold voltage differences can be compensated completely.

2. Only one extra reset is required for data voltage (Vdata) loading to prevent complexity.

3. The technology of placing transistor switch 470 that controls OLED current outside of pixel 500 increases the aperture ratio for pixel 500.

What is claimed is:

1. A driving circuit of active matrix organic electroluminescence display is disclosed and a driving circuit consisting of one scan line and one data line on a display panel includes:

a scan reset TFT, a gate of the scan reset TFT connected to the scan line and a drain of the scan reset TFT connected to the data line;

a storage capacitor, having two ends installed between a source of the scan reset TFT and a supply line (Vdd);

a driving TFT, a source of the driving TFT connected to the supply line (Vdd);

a detect TFT, a gate of the detect TFT connected to a Threshold-Lock, a drain of the detect TFT connected to the gate of the driving TFT and a source of the detect TFT connected to a drain of driving TFT;

a compensation capacitor, having two ends installed between source of the scan reset TFT and drain of the detect TFT;

an organic electroluminescence element, the anode of the organic electroluminescence element connected to the drain of the driving TFT and cathode connected to a common line;

a switch on the display panel is used to connect the common line and the grounding end.

2. The driving circuit of active matrix organic electroluminescence display according to claim 1, wherein the detect TFT of each pixel circuit on a display substrate is controlled by the Threshold-Lock.

3. The driving circuit of active matrix organic electroluminescence display according to claim 1, wherein the source of driving TFT in every pixel circuit on a display substrate is jointly connected to a supply line.

4. The driving circuit of active matrix organic electroluminescence display according to claim 1, wherein the cathode of organic electroluminescence element in every pixel circuit on a display substrate is jointly connected to a common line.

5. The driving circuit of active matrix organic electroluminescence display according to claim 1, wherein the switch is a thin film transistor (TFT).

6. The driving circuit of active matrix organic electroluminescence display according to claim 1, wherein the switch is controlled by a display line.

7. The driving circuit of active matrix organic electroluminescence display according to claim 1, wherein a cycle of driving signals can be divided into three phases: Threshold-Lock Phase, write phase and display phase.

8. The driving circuit of active matrix organic electroluminescence display according to claim 7, wherein voltage level of the data line is reset to be the same as that of supply line (Vdd) in the beginning of Threshold-Lock Phase.

9. The driving circuit of active matrix organic electroluminescence display according to claim 7, wherein the storage capacitor discharges and resets in Threshold-Lock Phase and the compensation capacitor memorizes the threshold voltage (Vth) of driving TFT.

10. The driving circuit of active matrix organic electroluminescence display according to claim 7, wherein data voltage in write phase will be stored in the storage capacitor as scan reset TFT is on and threshold voltage (Vth) previously memorized by the compensation capacitor will still be retained as detect TFT is off.

* * * * *